US007402055B2

(12) United States Patent
Chen et al.

(10) Patent No.: US 7,402,055 B2
(45) Date of Patent: Jul. 22, 2008

(54) CIRCUIT BOARD TYPE CONNECTOR

(75) Inventors: Ying-Chung Chen, Pan Chiao (TW); Chih-Chien Hung, Zhonghe (TW)

(73) Assignee: Chief Land Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/713,007

(22) Filed: Mar. 2, 2007

(65) Prior Publication Data

US 2008/0081491 A1 Apr. 3, 2008

(30) Foreign Application Priority Data

Sep. 28, 2006 (TW) ..... 95135958 A

(51) Int. Cl.
*H01R 12/00* (2006.01)

(52) U.S. Cl. ..... 439/74

(58) Field of Classification Search ..... 439/74, 439/79, 607–610, 353, 357–358, 328, 571, 439/377, 65

See application file for complete search history.

(56) References Cited

U.S. PATENT DOCUMENTS 3,803,533 A * 4/1974 Taplin ..... 439/328
4,418,976 A * 12/1983 Lenzini et al. ..... 439/358
5,472,354 A * 12/1995 Chen et al. ..... 439/357
7,192,297 B1 * 3/2007 Wu ..... 439/358

* cited by examiner

*Primary Examiner*—Edwin A. León
(74) *Attorney, Agent, or Firm*—Birch, Stewart, Kolasch & Birch, LLP

(57) ABSTRACT

A circuit board type connector includes a connector socket and a connector plug. In the connector plug, a circuit board replaces wires or cables to transmit signals. The connector is provided with a clipping device to clip the circuit board and securely connect the connector plug with the connector socket. The clipping device includes a pair of clips, a supporting plate and a circuit board cover to securely hold the circuit board. The clip engages with a clip connection slot of the connector socket to securely connect the connector plug with the connector socket.

10 Claims, 7 Drawing Sheets

CIRCUIT BOARD TYPE CONNECTOR

BACKGROUND OF THE INVENTION

1. Field of the Invention

The present invention relates generally to a connector, and in particular to a circuit board type connector. In the connector, a circuit board replaces wires or cables to transmit signals.

2. The Prior Arts

Generally, connectors are connecting components and their accessories for transmitting electronic signals and connecting power. The connectors are the connection among the signals. The qualities of the connectors not only affect the reliability of transmitting the currents and the signals, but also affect the operation quality of the whole electronic instruments.

The connectors used in computers are usually classified into two categories: I/O (Input/Output) and Interconnection. The I/O connector transmits signals between the computer main system and peripheral equipments, such as a mouse, a monitor, a keyboard, a printer, and a plotter. The I/O connector may also transmit signals between the computer main system and network systems. The I/O connectors include a circular connector, a rectangular connector, a coaxial connector, etc. The Interconnection connector is used in the main computer system and peripheral equipments, which provides signal connection in the installation of electronic components or between modules in the systems. The Interconnection connectors include an integrated circuit socket, a board edge connector, a flat cable, etc.

A conventional connector uses wires or cables to transmit signals. When the wires or cables are electrically connected to the connector, the wires have to be soldered to the terminals. It needs to solder the wires on by one, so it is time consuming to manufacture a channel cable. It also needs to keep spacing between soldering points, and thus it is hard to increase the wire density.

At present, some technical features, such as a display card, solve the problems mentioned above. Signals are transmitted via circuits on a circuit board instead of wires or cables. When the circuit board is inserted into a slot, such as a PCI slot, the circuit board still cannot work as a connector to transmit signals between two ends due to lacking of a supplementary fixture device. If there is no reliable fixture device, the circuit board is easy to get loose from the slot or the connection mount under pulling or impact on the circuit board. It leads to failure of the whole electronic device.

SUMMARY OF THE INVENTION

A primary objective of the present invention is to provide a circuit board type connector, whose connector plug uses a circuit board to transmit signals and a clipping device to securely join the connector plug and a connector socket together.

Based on the objective mentioned above, the circuit board type connector according to the present invention comprises a connector socket and a connector plug. One of technical features of the present invention is that the connector plug uses a circuit board to replace wires for transmitting signals. Another technical feature is that the connector plug comprises a clipping device to clip the circuit board and securely connect the connector plug (particularly the circuit board) with the connector socket. The clipping device, which comprises a pair of the clips, a supporting plate between the clips, and a clipping device cover, securely holds the circuit board.

The clips are inserted into corresponding slots in the connector socket, thereby achieving the secure connection.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
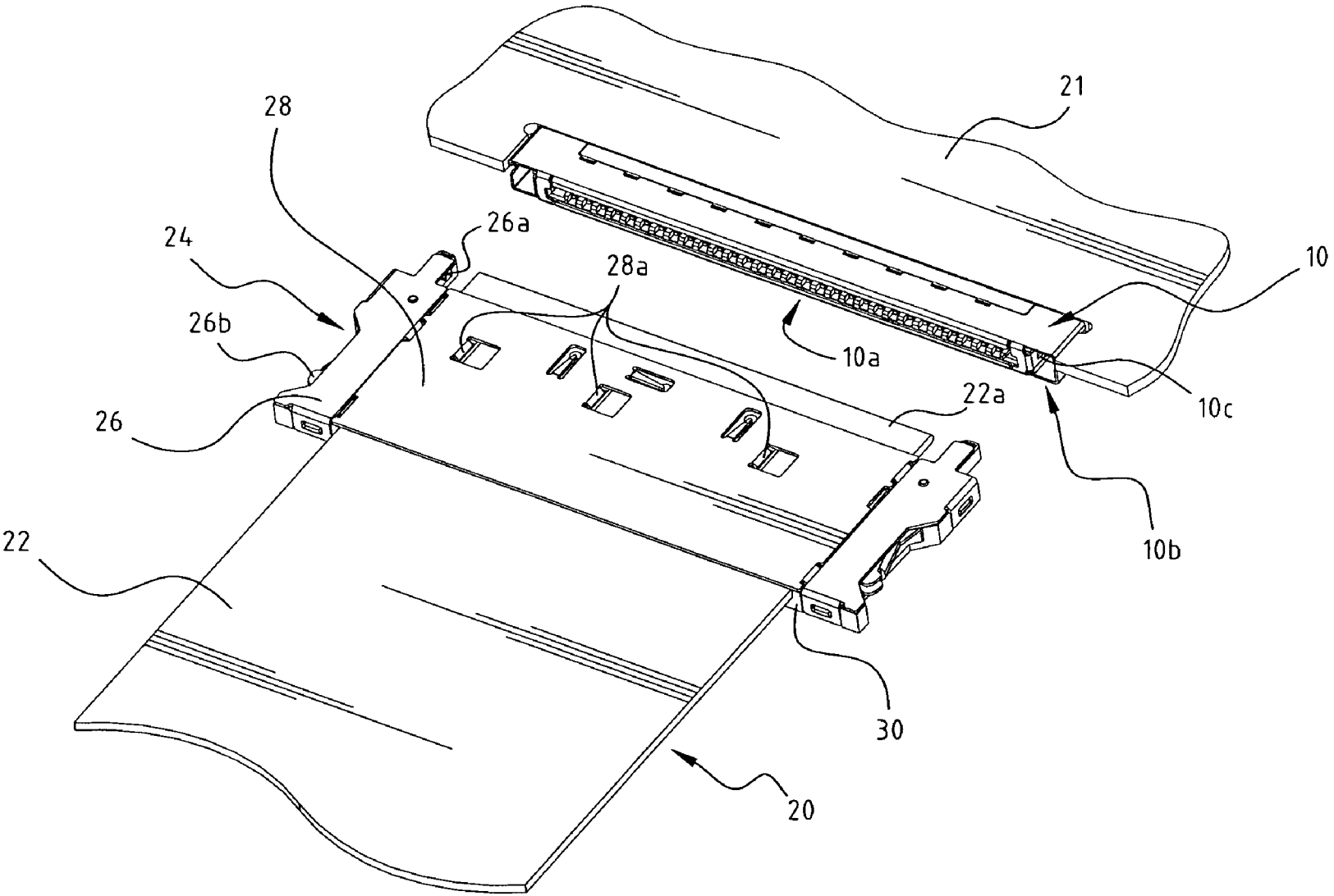
FIGS. 1A and 1B are schematic views showing a circuit board type connector according to the present invention.
Figure 1B:
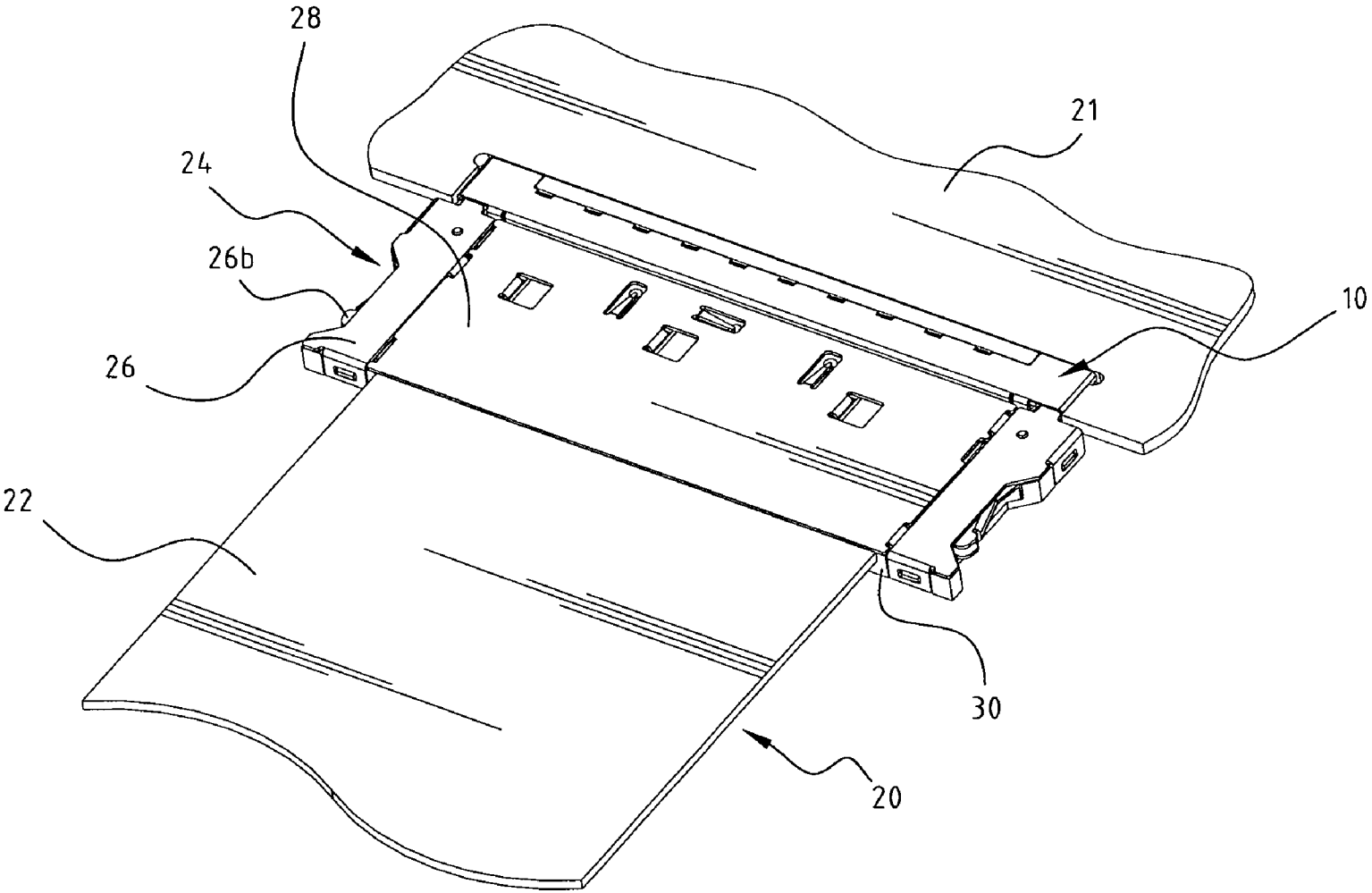

Referring to FIGS. 1A and 1B, a circuit board type connector comprises a connector socket 10 and a connector plug 20. The connector socket 10 is installed at an edge of a circuit board 21 and serves as an interface for the circuit board 21.

When another electronic device communicates with the circuit board 21, the connector plug 20 is the bridge for communication. In order to avoid the problems occurred during soldering wires to the connector plug 20, a circuit board type connector according to the present invention is provided with a circuit board 22 to replaces wires or cables for transmitting signals.

Figure 2B:
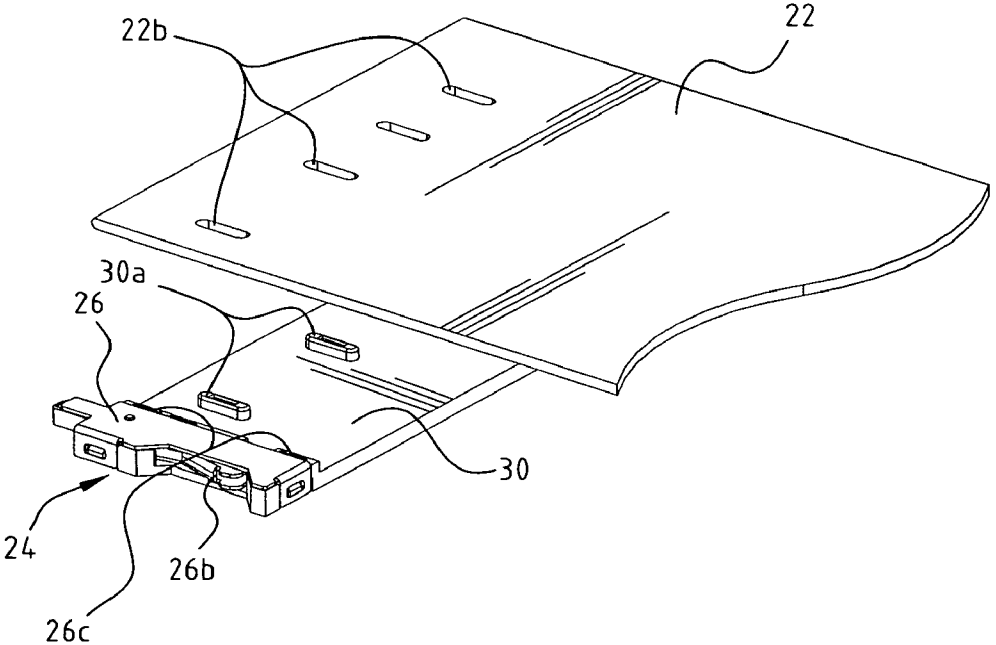
FIGS. 2A, 2B and 2C are schematic views showing the assembly of a clipping device and a circuit board.

If a circuit board, such as a display card, is directly inserted into a PCI slot without any fixture device, the connector plug 20 is easily got loose from the connector socket 10. In order to solve this problem, the circuit board type connector according to the present invention includes a clipping device 24 to grip the circuit board 22. Referring to FIG. 2B, the special structured clipping device 24 holds the circuit board 22 to insert the connector plug 20 (mainly connection points 22*a* on the circuit board 22) into the connector socket 10, thereby securely connecting the connector socket 10 and the connector plug 20. In order to achieve the secure connection, both of the connector socket 10 and the connector plug 20 have special structures corresponding to each other.

The connector socket 10 is a strip insulator and has an circuit board slot 10*a*, a clip connection slot 10*b* disposed at each lateral side of the circuit board slot 10*a*. The circuit board slot 10*a* comprises a plurality of connection points therein. A hook connection slot 10*c* is disposed between the circuit board slot 10*a* and the clip connection slot 10*b* and on an insulation wall of the clip connection slot 10*b*. When the connector plug 20 electrically connects with the connector socket 10, the connection points 22*a* at the edge of the circuit board 22 electrically connect with the connection points in the circuit board slot 10*a*.

Figure 2A:
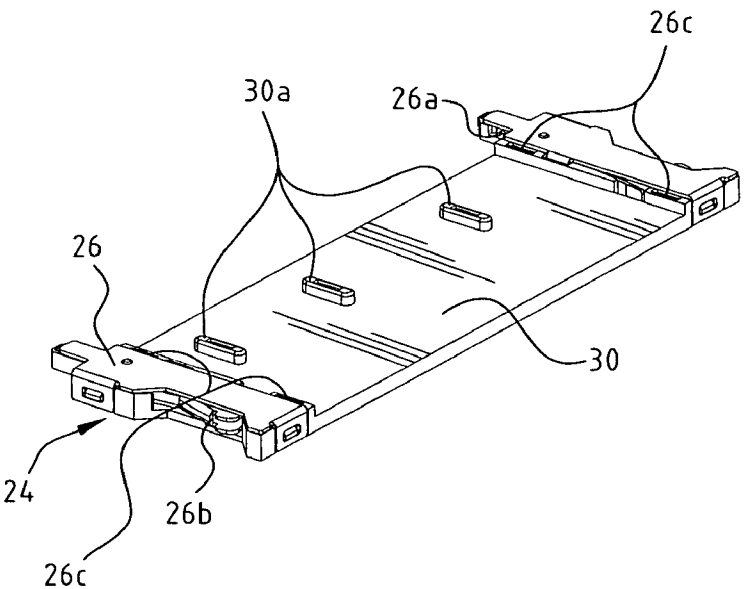
Figure 2C:
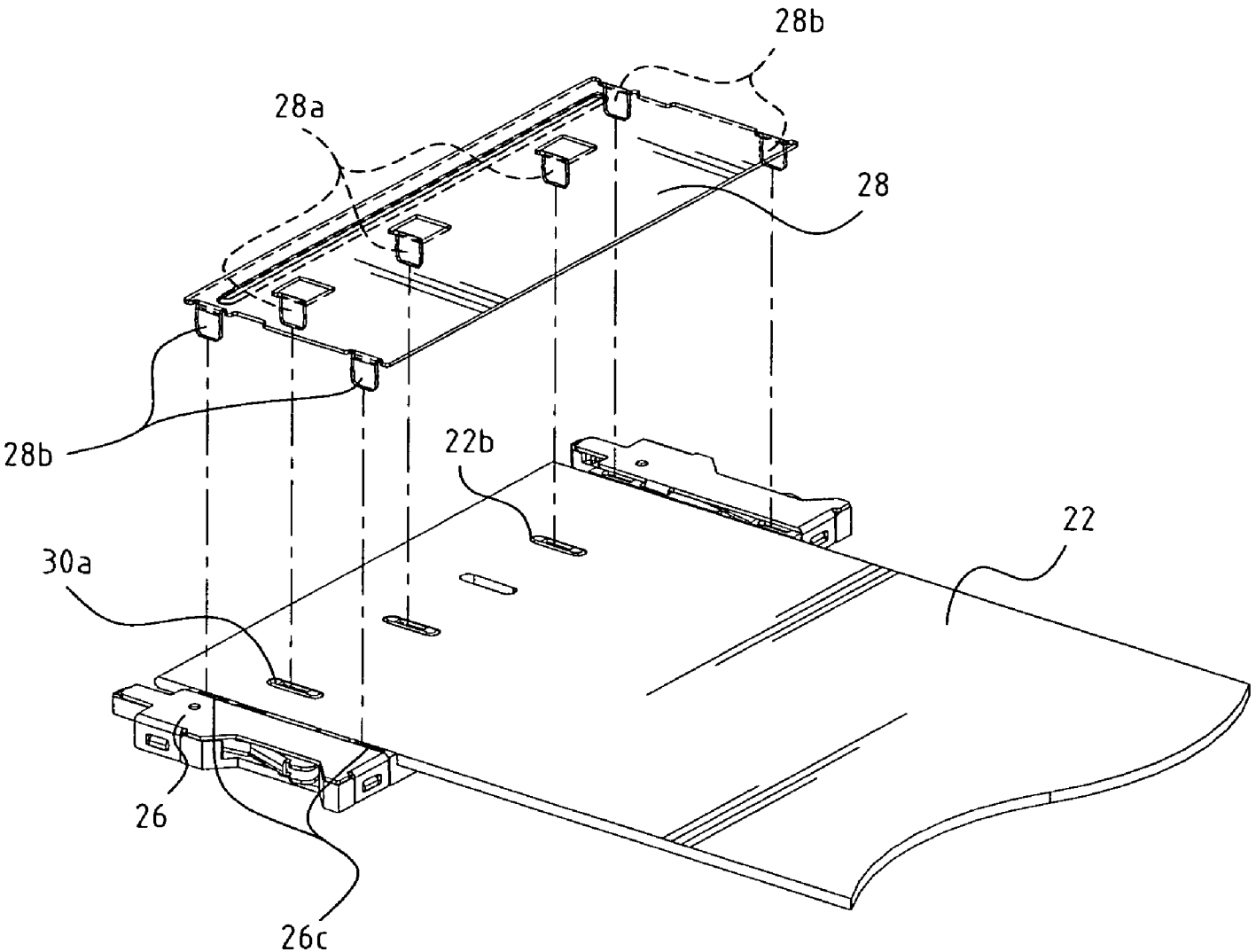

Referring to the FIGS. 2A, 2B and 2C, the connector plug 20 comprises the circuit board 22 and the clipping device 24. The circuit board 22 includes circuits electrically connected with the connection points 22*a* and at least one assembly through hole 22*b* for assembling with the clipping device 24. The clipping device 24 comprises at least a pair of clips 26, a supporting plate 30 installed between the clips 26, and a circuit board cover 28. The width of the supporting plate 30 is corresponding to that of the circuit board 22. The size of the clip 26 is corresponding to that of the clip connection slot 10*b* of the connector socket 10. The clip 26 has a hook 26*a* and a press portion 26*b* associated with the hook 26*a*.

Referring to FIG. 1A, when the connector plug 20 is inserted into the connector socket 10, press the press portions 26*b* to draw the hooks 26*a* back inside the clips 26, and then insert the circuit board 22 (especially the portion with the connection points 22*a*) of the connector plug 20 into the circuit board slot 10*a* of the connector socket 10. If the hook 26*a* is not drawn back, it is exposed outside an opening of the clip 26. When the connector plug 20 is inserted into the connector socket 10, the wall between the circuit board slot 10*a* and the clip connection slot 10*b* blocks the exposed hook 26*a*. Thus, the connector plug 20 cannot be completely inserted into the connector socket 10. After the connector plug 20 is fully inserted into the connector socket 10, release the press portion 26*b*. Thus the hook 26*a* returns to its original state, which the hook 26*a* is projected outside the clip 26. The size of the hook 26*a* is corresponding to that of the hook connection slot 10*c* of the connector socket 10. When the hook 26*a* returns to its original state, the hook 26*a* engages with the hook connection slot 10*c* on the sidewall of the clip connection slot 10*b*. Therefore, the connector plug 20 would not easily get loosening from the connector socket 10. When removing the connector plug 20 from the connector socket 10, press the press portion 26*b* to disengage the hook 26*a* from the hook connection slot 10*c*.

Referring to FIGS. 2A to 2C, the circuit board cover 28 comprises at least one first clipping piece 28*a* corresponding to assembly through hole 22*b* vertically extended from the bottom thereof and at least one second clipping piece 28*b* vertically extended downward from each lateral edges thereof. The supporting plate 30 comprises at least one first clipping groove 30*a* corresponding to the first clipping pieces 28*a* and the assembly through hole 22*b*. The clip 26 comprises at least one second clipping groove 26*c* corresponding to the second clipping piece 28*b* of the circuit board cover 28. The first clipping groove 30*a* and the second clipping groove 26*c* are elastic and capable of securely clipping the first clipping piece 28*a* and the second clipping piece 28*b*, respectively.

When the supporting plate 30, the clips 26, the circuit board cover 28, and the circuit board 22 are assembled together, first of all, align the assembly through hole 22*b* of the circuit board 22 with the first clipping groove 30*a* on the supporting plate 30 as shown in FIG. 2B. As shown in FIG. 2C, the first clipping piece 28*a* and the second clipping pieces 28*b* are then inserted into and clipped by the first clipping groove 30*a* and the second clipping grooves 26*c*, respectively. The supporting plate 30, the clips 26, and the circuit board cover 28 are securely assembled to form the clipping device 24, thereby holding the circuit board 22.

There are many prior arts how the press portions 26*b* links with the hook 26*a*. In addition to a clip including a spring, the clip may comprise a link mechanism to link the press portions 26*b* with the hook 26*a*. In the following, a linkage mechanism according to an embodiment is described in detail, but not limited to such mechanism.

Figure 3:
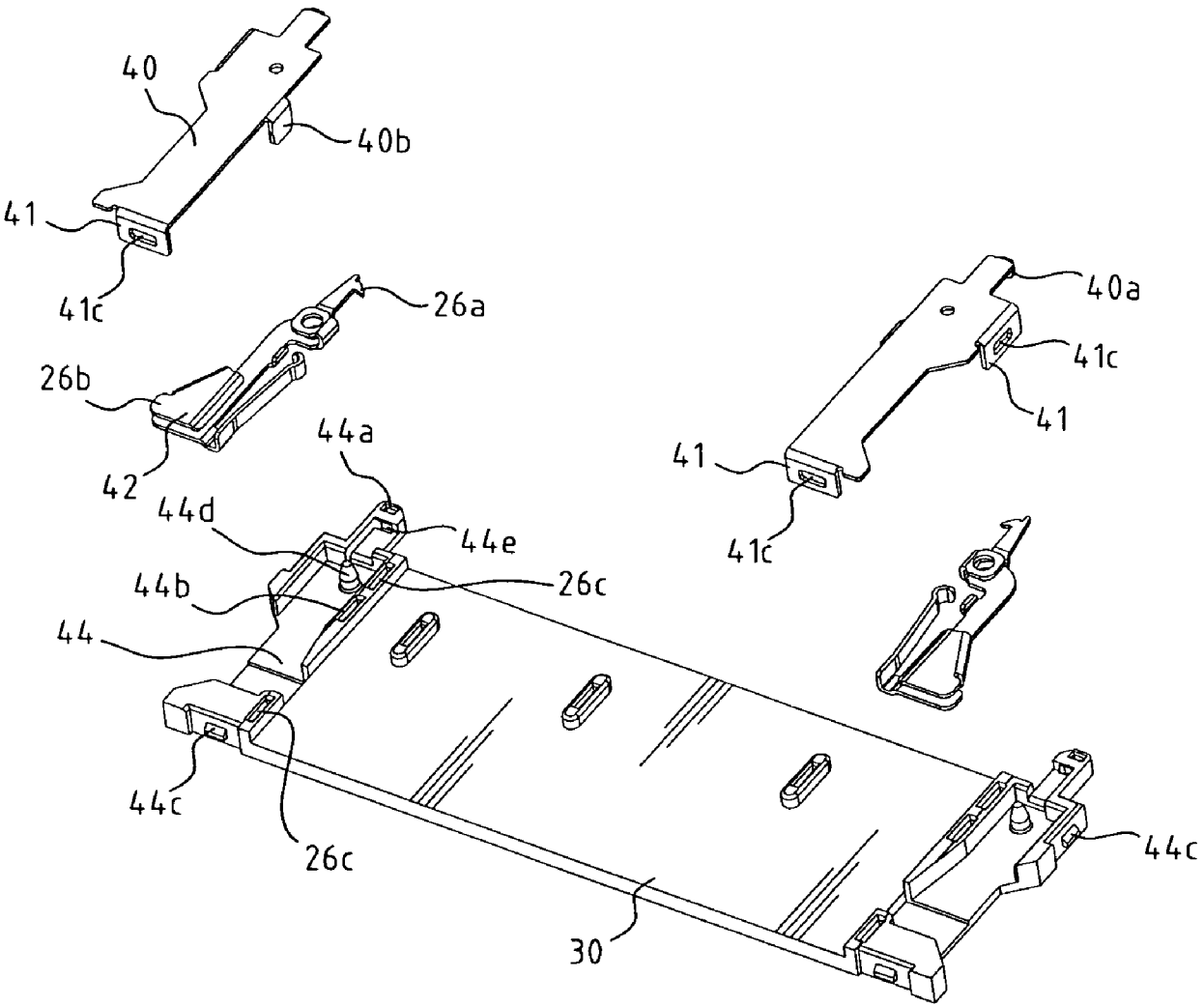
FIG. 3 is a schematic view showing a pair of clips and a supporting plate according to the present invention.

FIG. 3 is a schematic view showing the clip 26 according to the present invention. The clip 26 further includes a clip case and a press member 42 mounted in the clip case. The press member 42 has the hook 26*a* at one end and the press portions 26*b* at the other end.

For example, the clip case includes a clip base 44, and a clip cover 40. The clip base 44 comprises a plurality of walls 46*a*, 46*b*, and 46*c* to form a grooved body. The clip base 44 further comprises a pivot post 44*d*, a tip portion recess 44*e*, inlet slots 44*a*, 44*b* on tops of walls 46*a*, 46*b*, and a fixture piece 44*c* projected from an outside wall. The inlet slots 44*a*, 44*b* are elastic and capable of securely gripping corresponding pieces inserted thereinto.

The clip cover 40 comprises at least one retainer piece 41 with a fixture hole 41*c*, and inlet pieces 40*a*, 40*b* vertically extended from edges of the clip cover 40. The sizes of the inlet pieces 40*a*, 40*b* are corresponding to those of the inlet slots 44*a*, 44*b*, respectively. The size of the fixture hole 41*c* is corresponding to that of the fixture piece 44*c* of the clip base 44. The fixture hole 41*c* is elastic and capable of securely clipping the fixture piece 44*c* inserted thereinto.

The press member 42 is disposed between the clip base 44 and the clip cover 40. When the clip base 44 and the clip cover 40 are assembled to form the clip case, first of all, align the inlet pieces 40*a*, 40*b* with the inlet slots 44*a*, 44*b*. The clip cover 40 is then pressed to insert the inlet pieces 40*a*, 40*b* into the inlet slots 44*a*, 44*b*, respectively. At the same time, the fixture piece 44*c* is snapped into the fixture hole 41*c*. Thus, the clip cover 40 is securely mounted on the clip base 44. After the assembly, the press portions 26*b* and the hook 26*a* of the press member 42 are projected out of two openings of the clip base 44.

It is necessary to pay attention to an insertion end of the clip base 44, which covers the hook 26*a*. It is the part protruded beyond the edge line of the circuit board 22. The clip base 44 is made of plastic and with a low strength. It is likely to be damaged during the assembling. Therefore, the clip cover 40 is extended to cover the hook 26*a*, and uses the inlet piece 40*a* inserted into the inlet slot 44*a* to reinforce the insertion end of the clip case.

Figure 4:
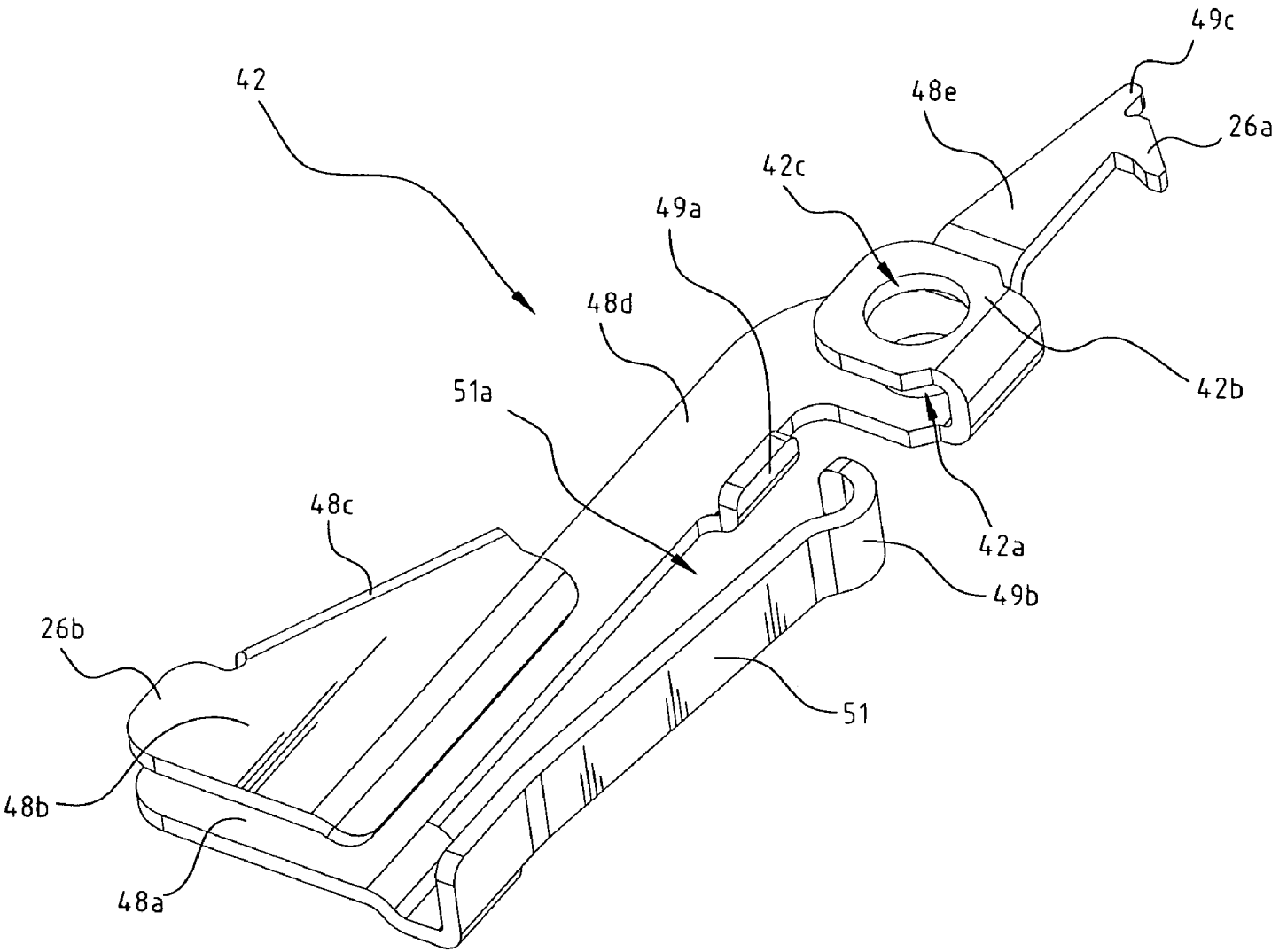
FIG. 4 is a schematic view showing a press member according to the present invention.

Referring to FIG. 4, the press member 42 according to the present invention includes a press base 48*a*, a flexible arm 51, a p-shaped arm 48*d* having a pivot through hole 42*a*, and a hooked portion 48*e*. The press member 42 may further comprise an accessory press base 48*b*, an accessory pivot portion 42*b* having an accessory pivot through hole 42*c*, a contact end 49*b*, and a contact projection 49*a*.

The press base 48*a* is approximately a triangle and includes the press portion 26*b* at an outer side thereof. The flexible arm 51 is a strip extended from an inner side of the press base 48*a*. The p-shaped arm 48*d* is extended from a top end of the press base 48*a* and has the pivot through hole 42*a* corresponding to the pivot post 44*d* of the clip base 44. The hooked portion 48*e* is extended from the p-shaped arm 48*d* and has the hook 26*a* and a tip portion 49*c*.

Figure 5:
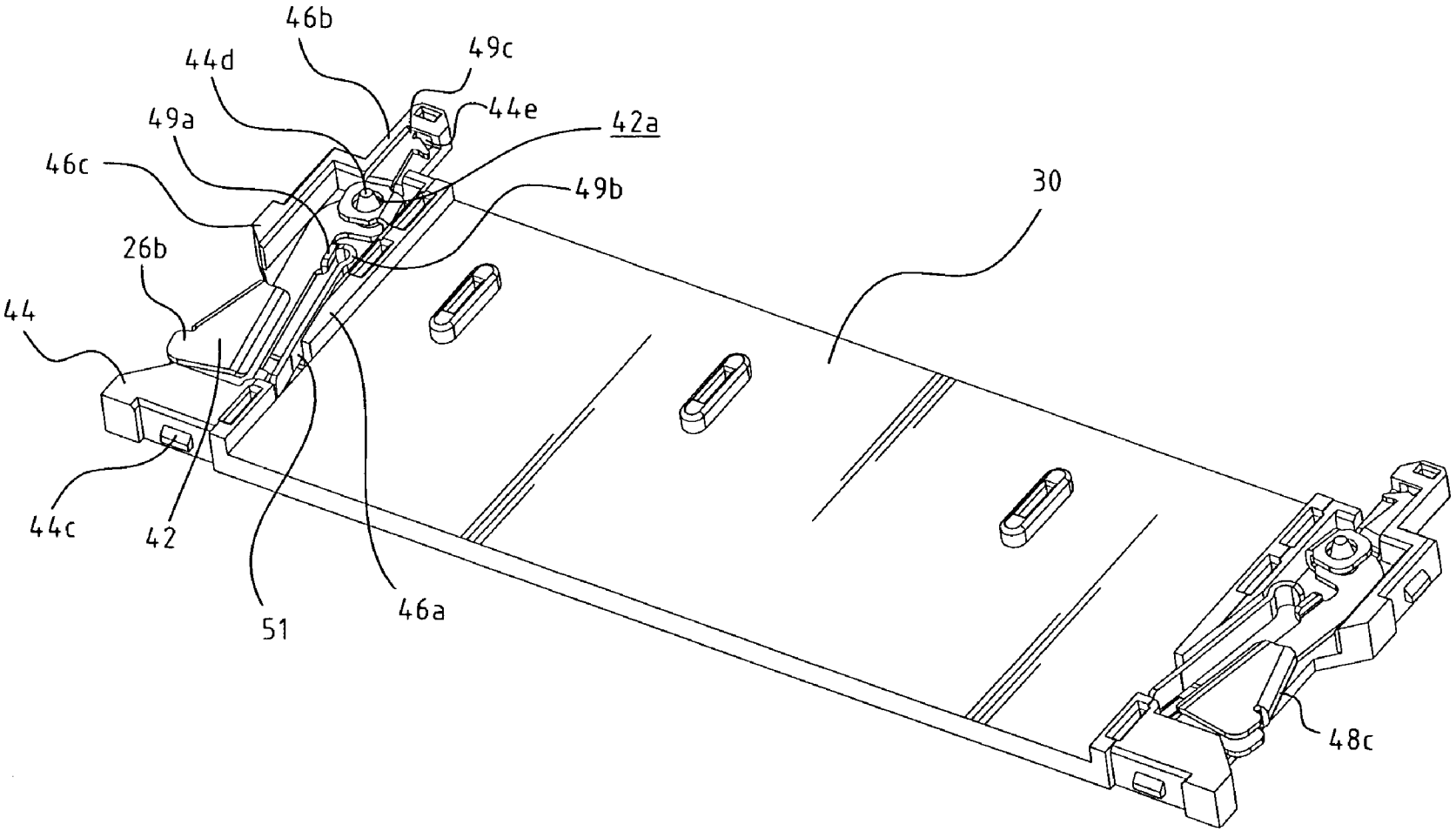
FIG. 5 is a schematic view showing the assembly of the clips according to the present invention.

FIG. 5 is a schematic view showing the assembly of the clip 26. The pivot through hole 42*a* of the press member 42 is aligned with the pivot post 44*d* of the clip base 44, and the press member 42 is then mounted on the clip base 44. The tip portion 49*c* of the hooked portion 48*e* is inserted into the tip portion recess 44*e* of the clip base 44.

When the press portion 26*b* is pressed, the press member 42 rotates about the pivot post 44*d* and the pivot through hole 42*a*. Thus, the hook 26*a* is drawn back in the clip base 44 and the flexible arm 51 is pressed against the wall 46*a* and approaching the p-shaped arm. Because the tip portion 49*c* is disposed in the tip portion recess 44*e*, the moving range of the hook 26*a* is limited by the tip portion recess 44*e*. When the press member 42 is released, the deformed flexible arm returns to its original state. The press member 42 rotates about the pivot through hole 42*a* and the pivot post 44*d*, and the hook 26*a* is moved out of the opening of the clip base 44.

Besides, the press member 42 is provided with mechanisms to prevent over stress. When the press portion 26*b* is pressed, the flexible arm 51 is pressed against the wall 46*a* of the clip base 44, the hooked portion 48*e* is limited by the wall

46*b*, and the portion surround the pivot through hole 42*a* of the p-shaped arm 48*d* is limited by the wall 46*c*. These mechanisms prevent the clip 26 from damage when the force applied on the press portion 26*b* is too large.

A flexible space 51*a* is disposed between the flexible arm 51 and the press base 48*a*. The flexible arm 51 comprises a contact end 49*b*. The p-shaped arm 48*d* comprise a contact projection 49*a* corresponding to the contact end 49*b*. When the press proportion 26*b* is pressed, the contact end 49*b* is pressed against the contact projection 49*a*. Thus, the flexible arm 51 would not be damaged due to approaching the p-shaped arm 48*d* too much. It further prevents the clip 26 from damage when the force applied on the press portion 26*b* is too large.

In order to enhance the connection of the pivot post 44*d* and the pivot through hole 42*a*, the end of the p-shaped arm 48*d* may be further extended to form a J-shaped accessory pivot portion 42*b*. The accessory pivot portion 42*b* includes an accessory pivot through hole 42*c* corresponding to the pivot through hole 42*a* and the pivot post 44*d*. Thus, the pivot post 44*d* connects with two through holes 42*a*, 42*c*, thereby enhancing the connection.

In order to make it easier to press the press portion 26*b*, the press base 48*a* may be further extended to form a base connection portion 48*c* and an accessory press base 48*b*. The press portions 26*b* is located on a U-shaped structure comprising the press base 48*a*, the accessory press base 48*b* and the base connection portion 48*c*. Thus, thicker bases make it easier to press the press portion 26*b*.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A circuit board type connector, comprising:

a connector socket, which is a strip insulator, including a circuit board slot and a clip connection slot disposed at each lateral side of the circuit board slot; wherein a plurality of connection points are disposed in the circuit board slot; a hook connection slot is disposed on a sidewall of the clip connection slot and between the circuit board slot and the clip connection slot; and a connector plug, including:

a circuit board including a plurality of connection points at an edge thereof, and at least one assembly through hole; and a clipping device including a pair of clips, a supporting plate installed between the clips, and a circuit board cover; wherein a width of the supporting plate corresponds to that of the circuit board, a size of the clip corresponds to that of the clip connection slot, and the clip includes a press portion and a hook corresponding to the hook connection slot, wherein the clip further includes a clip case and a press member mounted inside the clip case, and the press member comprises the press portion at one end and the hook at the other end.

2. The connector as claimed in claim 1, wherein the supporting plate further comprises at least one first clipping groove corresponding to the assembly through hole of the circuit board, the circuit board cover further comprises at least one first clipping piece vertically extended therefrom, and a size of the first clipping piece is corresponding to those of the assembly through hole and the first clipping hole.

3. The connector as claimed in claim 1, wherein the circuit board cover further comprises at least one second clipping piece vertically extended from each lateral edge thereof, and the clip further includes at least one second clipping groove corresponding to the second clipping piece.

4. The connector as claimed in claim 1, wherein the clip case further comprises:

a clip base, which is a groove-shaped structure, including a plurality of walls, an opening for the hook, a pivot post and a tip portion recess, wherein at least one inlet slot is disposed on tops of the walls and at least one fixture piece is disposed on an outer surface of the wall; and a clip cover having at least one inlet piece and at least one retainer piece vertically extended from edges thereof, wherein a size of the inlet piece is corresponding to that of the inlet slot, and the retainer piece includes a fixture hole corresponding to the fixture piece.

5. The connector as claimed in claim 1, wherein the press member further comprises:

a triangular press base including the press portion at the border thereof;

a flexible arm extended from a side of the press base opposite to the press portion;

a p-shaped arm extended from a top end of the press base and having a pivot through hole corresponding to the pivot post; and a hooked portion extended from the p-shaped arm and having the hook and a tip portion.

6. The connector as claimed in claim 5, wherein a flexible space is disposed between the flexible arm and the press base.

7. The connector as claimed in claim 5, wherein the tip portion is in the tip portion recess of the clip base when the clip is assembled.

8. The connector as claimed in claim 5, wherein the flexible arm further comprises a contact end and the p-shaped arm further comprises a contact projection corresponding to the contact end.

9. The connector as claimed in claim 5, wherein the portion surrounding the pivot through hole is further extended to form a J-shaped accessory pivot portion having an accessory pivot through hole corresponding to the pivot post and the pivot through hole.

10. The connector as claimed in claim 5, wherein an accessory press base is extended from the press base, and the press base and the accessory press base are a U-shaped structure.

* * * * *